United States Patent [19]

Shen

[11] Patent Number: 4,944,605

[45] Date of Patent: Jul. 31, 1990

[54] DRAWER SLIDES SETS

[76] Inventor: Ming T. Shen, No. 909, Fu Hsin Road, Chupei, Hsinchu, Taiwan

[21] Appl. No.: 415,632

[22] Filed: Oct. 2, 1989

[51] Int. Cl.[5] ..... A47B 88/00

[52] U.S. Cl. ..... 384/19; 312/341.1; 384/23

[58] Field of Search ..... 384/19, 22, 23; 312/341.1

[56] References Cited

U.S. PATENT DOCUMENTS 4,077,677 3/1978 Sekerich ..... 384/19
4,141,525 2/1979 Miller ..... 384/22 X
4,176,890 12/1979 Gorton ..... 312/341.1 X
4,555,147 11/1985 Jackson ..... 384/19

*Primary Examiner*—Thomas R. Hannon
*Attorney, Agent, or Firm*—Notaro & Michalos

[57] ABSTRACT

A drawer slide set includes a two part guide and a two part slide. The guide is made of a first plate which is formed into a guide-connector having a roller rotatably mounted thereon. The guide-connector has a profiled end which extends into a correspondingly shaped channel in a one piece guide rail. Screws or rivets fasten the guide-connector to the guide-rail. The two part slide comprises a one piece slide rail which defines a channel that receives the profiled end of a plate formed into a slide-connector. A roller is rotatably mounted to one end of the slide-connector.

4 Claims, 6 Drawing Sheets

DRAWER SLIDES SETS

FIELD AND BACKGROUND OF THE INVENTION

This invention relates to improved drawer slide sets, and more particularly to drawer slides which are strong and which can be produced with ease.

In the prior art, known drawer slides include two slide sets which each have a guide and a slide and which are mounted respectively on opposite sides of a drawer. The structure of these drawer slide sets is shown in FIG. 5. Each set comprises a guide 7 and a slide 8. The guide and slide are each made of steel plates which are cut, pressed with a U-shaped configuration, and formed, during a complex process, at their ends so that the slide can slide into the guide. Rollers 5 and 6 are then connected to the guide and slide. The guide 7 is mounted inside a cabinet and the slide 8 is mounted on the outside of a drawer. Due to the engagement of the guides and the slides on opposite sides of the drawer, the drawer can be opened or closed smoothly and easily. One drawback of the prior drawer slides is in the manufacturing processes. Much time and cost is needed to produce each piece of the prior art slide set. Moreover, and especially when the drawer is fully opened, the slide set must have enough strength to support the drawer. When the guide and slide are in their extreme separated position as shown in FIG. 6, the slide set often collapses at portions A and B near the ends of the guide and slide. To prevent this, it is known to produce the guide and slide of thicker material for obtaining enough strength and to reach international standards for the slide set. It will be understood that this increases the cost of the products, and further, the increased weight of the products leads to higher transportation fees.

SUMMARY OF THE INVENTION

It is the purpose of the present invention to mitigate and/or obviate the above-mentioned drawbacks in the manner set forth in the description of the preferred embodiment.

A primary object of the present invention is to provide an improved set of drawer slides having double engaged flanges for obtaining enough strength to support a fully opened drawer.

Another objective of the present invention is to produce a set of drawer slides including an independent connector and rail which can easily be engaged to each other and which both can be rapidly produced without difficulty.

Further objectives and advantages of the present invention will become apparent as the following description proceeds. The features of novelty which characterize the invention are defined in the claims annexed to and forming a part of this disclosure.

DESCRIPTION OF THE PREFERRED EMBODIMENT

The following is a detailed description of the best presently contemplated embodiment of the invention. This description is not to be taken in a limiting sense, but is made merely for the purpose of illustrating the general principles of the invention.

Figure 1:
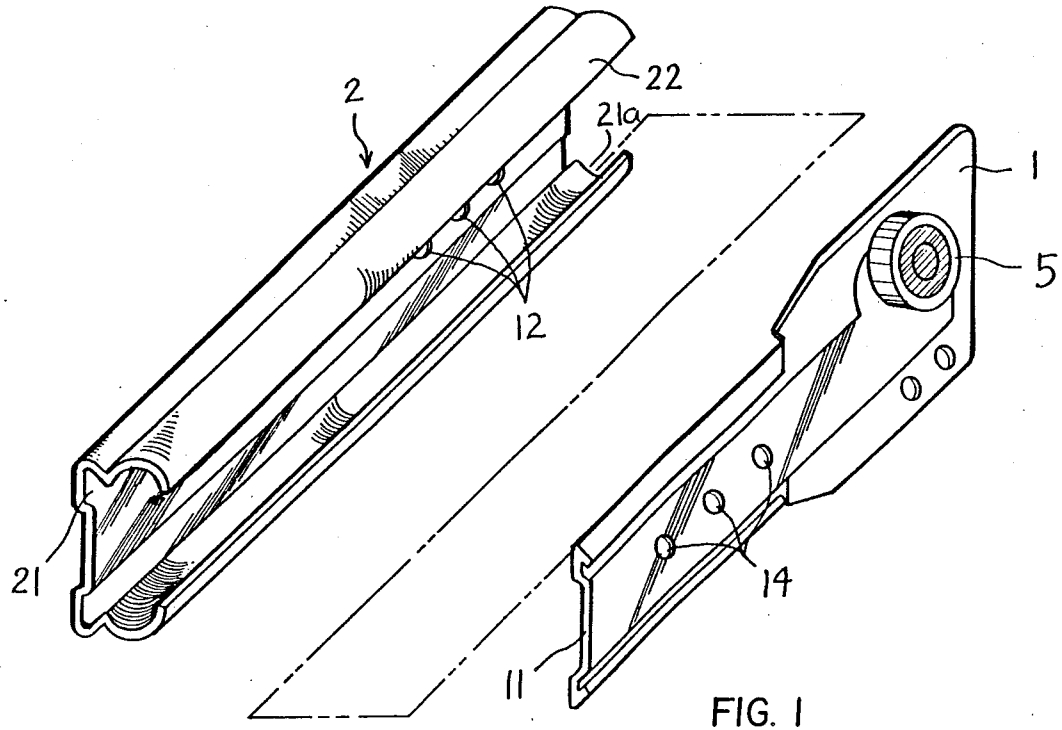
FIG. 1 is a perspective exploded view of a guide according to the present invention for use in a cabinet on one side of a drawer and looking at the inner end of the guide which will be deepest in the cabinet.
Figure 2:
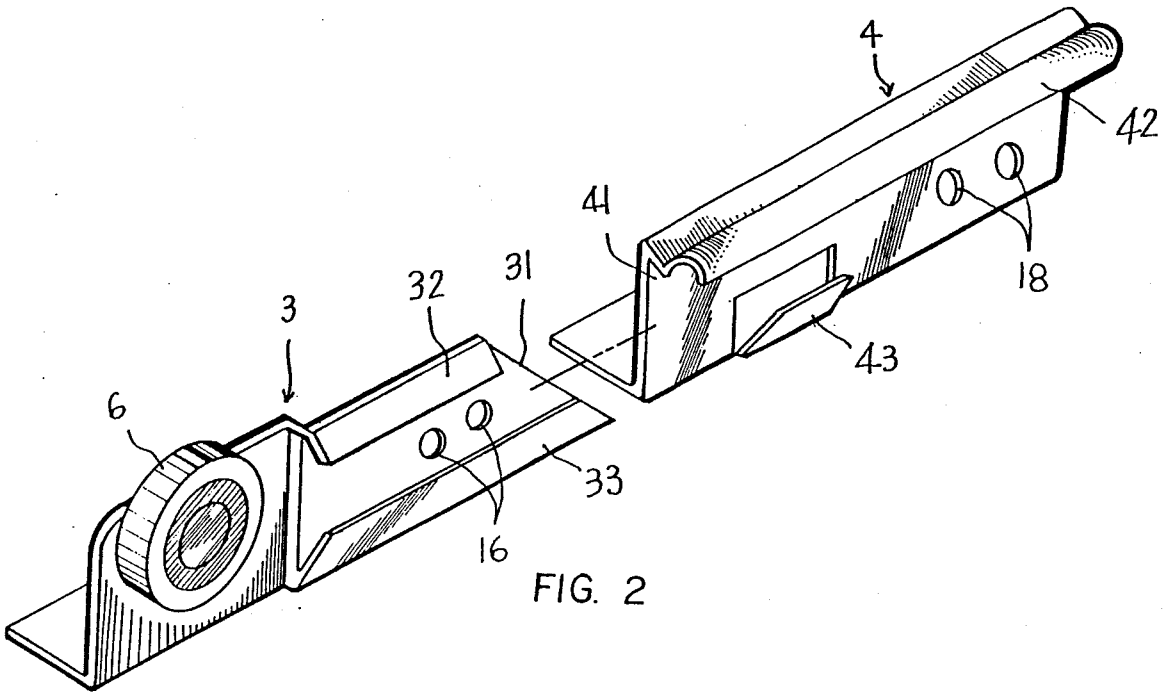
FIG. 2 is a perspective exploded view of a slide according to the present invention for use on the opposite side of the drawer and looking at the inner end of the slide which will be on the deepest part of the drawer.

Referring to FIGS. 1 and 2, the present invention includes a guide-connector 1, a guide-rail 2, a slide-connector 3, and a slide-rail 4. The guide-connector 1 is made of a single plate with a roller 5 rotatably connected to the side of the outer end of the plate, that is at the end at the front of a cabinet that will receive the guide. Plate 1 also has an inner portion 11 with upper and lower hook profiles. The guide-rail 2 can be made of one molded piece having upper and lower curved flanges 22 with a channel 21 therebetween. The inner end portion 11 of the guide-connector 1 is shaped to just fit and engage within the outer end of the channel 21 (at 21*a*) of the guide-rail 2. Connector 1 is fixed to rail 2 by fasteners like screws or rivets extending through mating holes 12 and 14 in the two elements.

As shown in FIG. 2, the slide-connector 3 is also made as an independent plate with a roller 6 rotatably connected to the inner end thereof. The outer end 31 of the plate is inclined outwardly from an upper bent edge 32 to a lower bent edge 33 thereof. The slide-rail 4 has an arc shaped flange 42 with a V-shaped channel 41 thereunder at its upper edge and a punched out inclined base 43 at its lower edge. The end 31 of the slide-connector 3 is shaped to engage within the slide-rail 4 by inserting the upper edge 32 under the V-shaped channel 41 and putting the lower edge 33 within the recess formed by the inclined base 43. Connector 3 is fixed to rail 4 by fasteners like screws or rivets in mating holes 16 and 18.

Figure 3:
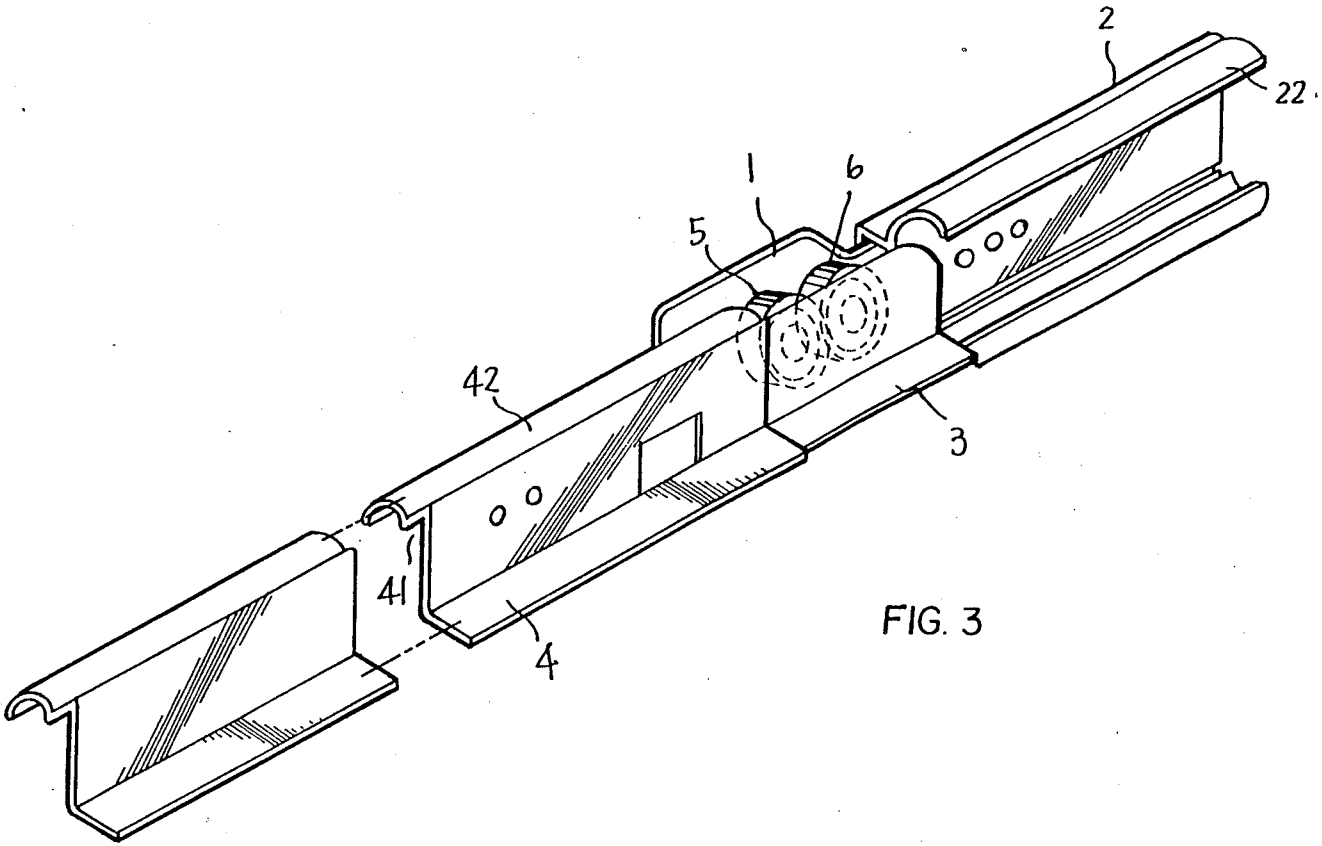
FIG. 3 is a perspective view of an assembled guide for the opposite side of the drawer, engaged with the assembled slide of FIG. 2, looking toward an opening of the cabinet and with the drawer in its maximum open position (neither the drawer nor cabinet being shown)
Figure 4:
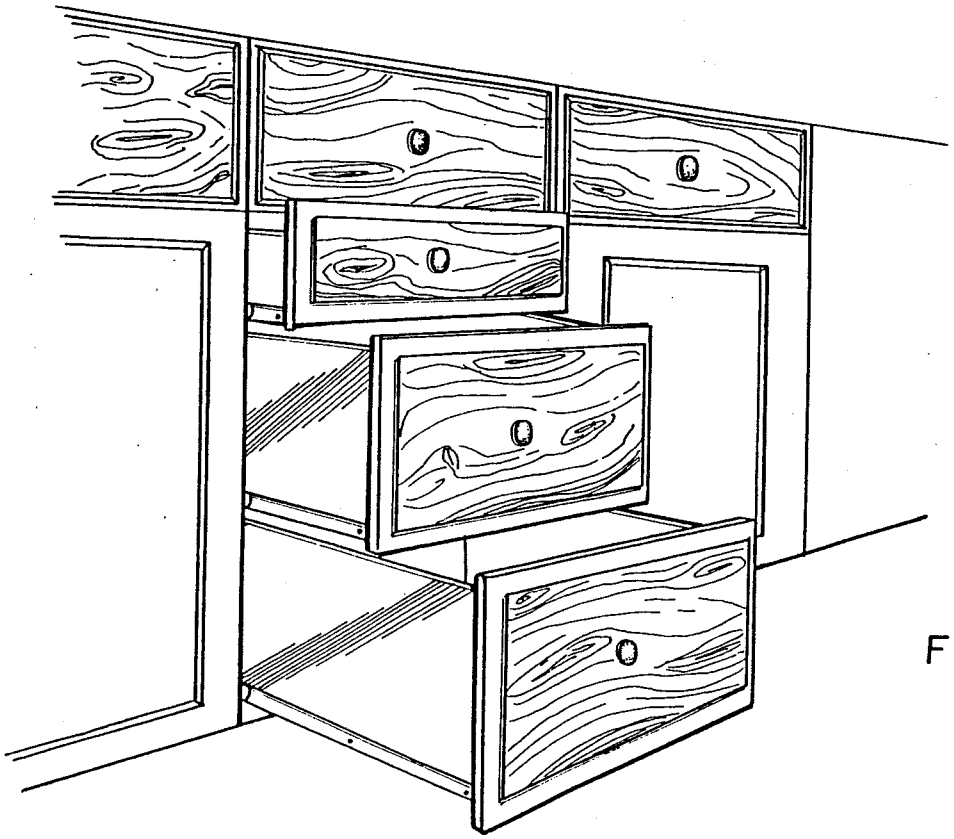
FIG. 4 is a perspective view of a cabinet with drawers using the guides and slides of the present invention.
Figure 5:
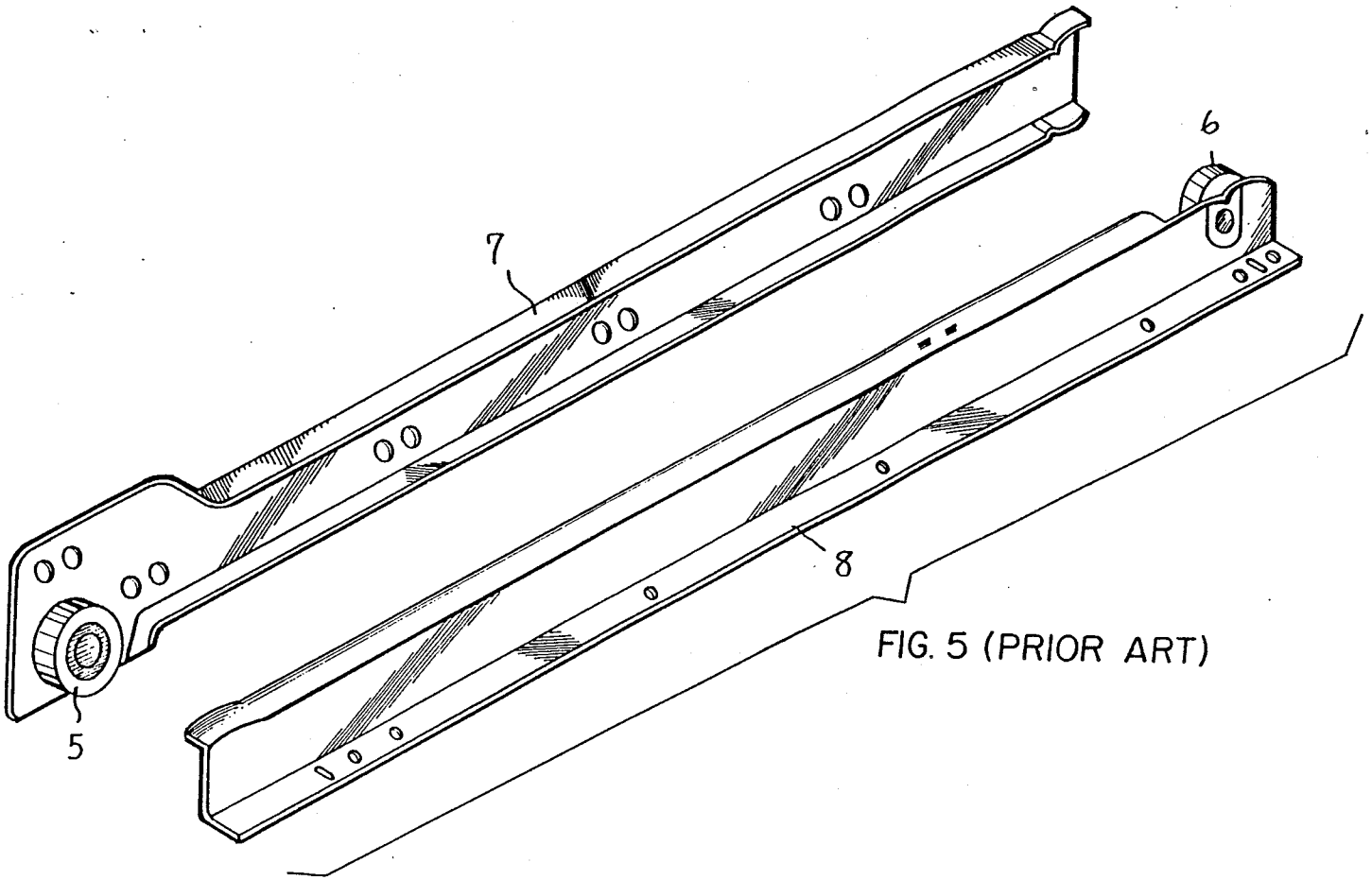
FIG. 5 (PRIOR ART)
FIG. 5 is a perspective exploded view of a prior guide and slide set.
Figure 6:
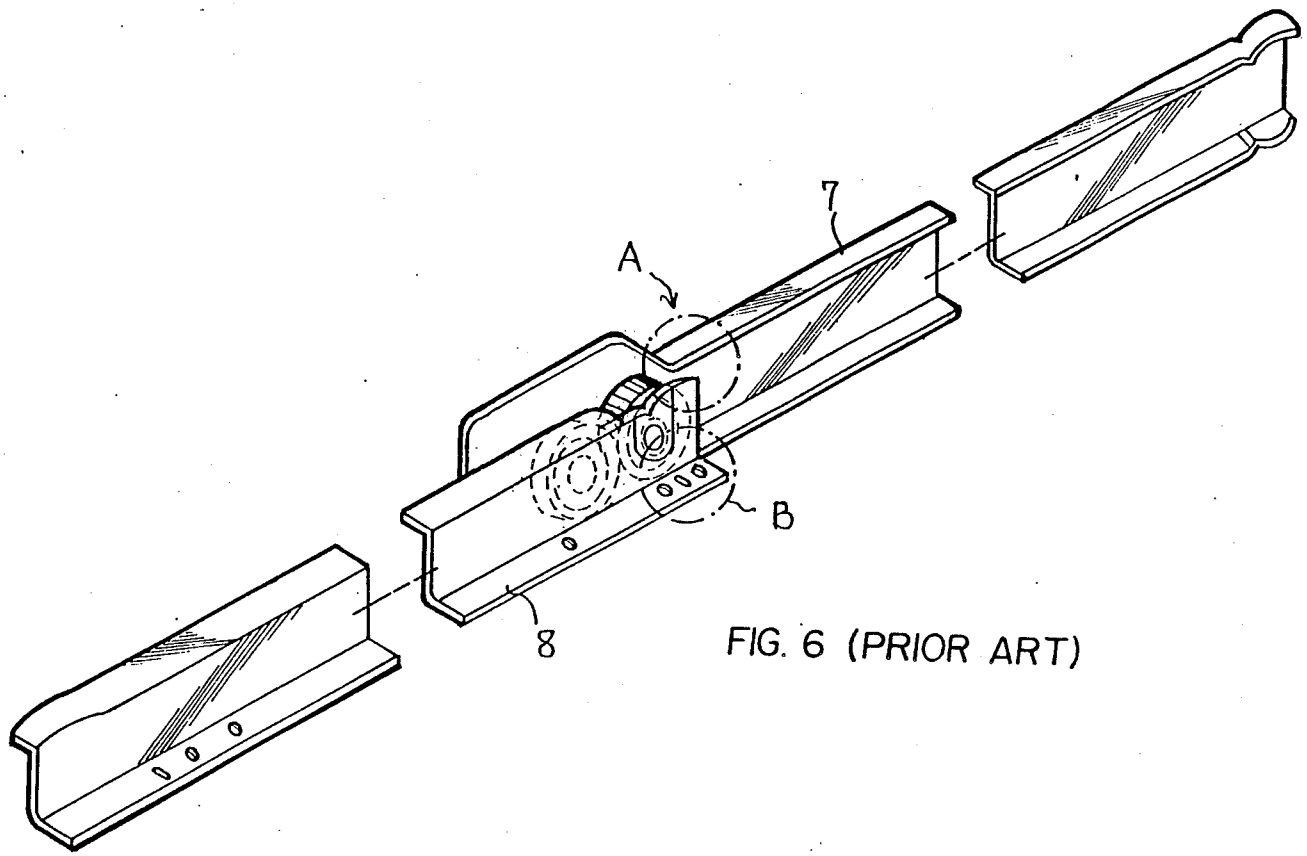
FIG. 6 (PRIOR ART)
FIG. 6 is a perspective view of the guide and slide of FIG. 5 in a position with the drawer in its maximum open position.

In FIGS. 3 and 4, the guide set is mounted in a cabinet and the slide set is provided on the side face of the drawer. In use, the arc flange 42 of the slide-rail 4 is received under the upper curved flange 22 of the guide-rail 2 having a larger contactable face and the two rollers 5 and 6 are positioned within the respective rail 4 and 2. When the drawer is fully opened (as shown at the bottom drawer in FIG. 4) the guide and slide are in the position shown in FIG. 3. In this position the invention provides enough strength to support the drawer and even more, if needed. This is because of the larger contacting surfaces of the guide and slide which can bear more stress, and the fact that the points of potential collapse at the hooked portion and channel of the guide and slide sets, have a greater strength in the invention to support the weight. It is to be understood that the present invention can provide enough strength to support the drawer without increasing the thickness of the guide and slide. In an experiment, the thickness of prior sets must be more than 1.5 mm to reach the international standard, while plates of only about 0.8–1.2 mm can reach the standard according to the present invention.

Another advantage of the present invention is that the elements of the invention are very easy to manufacture. Both the rails of the guide and slide sets can be manufactured in one piece which is molded and cut. The connector of each can be made by pressing a single plate, and then connecting it to the related rail, rapidly and with ease. The weight of products of the invention decrease over the prior art and their cost is thus lower.

As various posible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. A drawer slide set comprising:

a guide for connection to the interior of a cabinet, said guide comprising a guide-connector (1) formed of a single plate having an inner portion (11) with upper and lower hook profiles, and an outer portion, a roller (5) rotatably mounted to a side of said outer portion of the single plate forming the guide-connector, a guide-rail (2) formed by a single molded piece of material and having upper and lower curved flanges (22), said guide-rail having a channel (21) therein with a shape confirming to the shape of the inner portion of the guide-connector for receiving the inner portion of the guide-connector therein near an outer end of the guide-rail, said guide including means for fixing said guide-connector to said guide-rail;

a slide adapted for connection to the side of a drawer for sliding engagement on said guide to permit the draw to slide into and out of the cabinet, said slide comprising a slide-connector (3) formed of a single plate having an outer end (31) and upper and lower bent edges (32, 33), said slide-connector having an inner portion and a roller (6) rotatably mounted to a side of said inner portion of said slide-connector, said slide including a slide-rail (4) with an upper arc flange (42) on an upper edge thereof and a V-shaped channel (41) formed under said arc flange near the upper edge of said slide-rail, said slide-rail including an inclined base (43) defining a recess, said outer end with said upper and lower bent edges of said slide-connector conforming in shape to said V-shaped channel and the recess form by said inclined base, said outer end with said upper and lower bent edges of said slide-connector being received within said V-shaped channel and the recess of said inclined base, said slide including means for fixing said slide connector to said slide-rail; and said upper curved flange (22) being larger than said arc flange (42) so that with said slide slidably engaged to said guide, said arc flange is in sliding contact under said curved flange and, with relative movement between said sliding guide, said rollers (5, 6) of said guide-connector and said slide-connector roll respectively on said slide-rail (4) and said guide-rail (2).

2. A drawer slide set according to claim 1, wherein said outer end of said slide-connector is inclined downwardly and outwardly from said upper bent edge to said lower bent edge.

3. A drawer slide set according to claim 2, wherein said fixing means of said guide comprise mating holes through said guide-rail and said guide-connector, for receiving fasteners to connect said guide-rail to said guide-connector.

4. A drawer slide set according to claim 3, wherein said fixing means of said slide comprise mating holes in said slide-rail and said slide-connector for receiving fasteners for connecting said slide-rail to said slide-connector.

* * * * *